US007504004B2

(12) United States Patent
Michelotti

(10) Patent No.: US 7,504,004 B2
(45) Date of Patent: Mar. 17, 2009

(54) APPARATUS FOR CONTINUOUSLY PRODUCING A BAND OF PAPER PARTICULARLY FOR TOILET USE

(75) Inventor: Riccardo Michelotti, Pescia-Pistoia (IT)

(73) Assignee: SCA Hygiene Products AB, Gothenburg (SE)

( * ) Notice: Subject to any disclaimer, the term of this patent is extended or adjusted under 35 U.S.C. 154(b) by 108 days.

(21) Appl. No.: 11/529,308

(22) Filed: Sep. 29, 2006

(65) Prior Publication Data

US 2007/0017118 A1 Jan. 25, 2007

Related U.S. Application Data

(63) Continuation of application No. PCT/EP2005/003341, filed on Mar. 30, 2005.

(30) Foreign Application Priority Data

Apr. 2, 2004 (IT) ..... MI2004A000676

(51) Int. Cl.
*D21F 5/02* (2006.01)

(52) U.S. Cl. ..... 162/359.1; 162/206; 162/358.1; 34/454; 34/611

(58) Field of Classification Search ..... 162/358.1, 162/204–207, 363, 364, 367, 368; 100/37, 100/121, 118, 151, 153
See application file for complete search history.

(56) References Cited

U.S. PATENT DOCUMENTS

| | | | | | |
|---|---|---|---|---|---|
| 3,014,832 | A * | 12/1961 | Donnelly | 162/111 |
| 3,198,695 | A * | 8/1965 | Justus | 162/359.1 |
| 3,981,084 | A * | 9/1976 | Sobota | 34/123 |
| 4,302,282 | A * | 11/1981 | Young | 162/111 |
| 4,324,613 | A * | 4/1982 | Wahren | 162/111 |
| 4,781,795 | A * | 11/1988 | Miller | 162/358.5 |
| 5,127,168 | A * | 7/1992 | Pikulik | 34/423 |
| 5,399,241 | A * | 3/1995 | Oriaran et al. | 162/112 |
| 5,401,232 | A * | 3/1995 | Sailas | 492/38 |
| 5,439,559 | A * | 8/1995 | Crouse | 162/358.5 |
| 6,248,210 | B1 * | 6/2001 | Edwards et al. | 162/111 |
| 6,523,278 | B1 * | 2/2003 | Coulson et al. | 34/453 |
| 2002/0088594 | A1 | 7/2002 | Edwards et al. | |
| 2002/0179269 | A1 * | 12/2002 | Klerelid | 162/206 |

FOREIGN PATENT DOCUMENTS

| | | |
|---|---|---|
| EP | 0 337 973 | 10/1989 |

* cited by examiner

*Primary Examiner*—Eric Hug
(74) *Attorney, Agent, or Firm*—Young & Thompson

(57) ABSTRACT

Apparatus for continuously producing a band of paper, particularly for toilet use, includes at least a device for forming the band of paper, a felt conveyor belt suitable for transporting the band of paper through a dehydrating device having at least one presser cylinder suitable for pressing the band of paper against a drying cylinder The presser cylinder has a diameter no smaller than one third of the diameter of the drying cylinder.

8 Claims, 2 Drawing Sheets

FIG_2
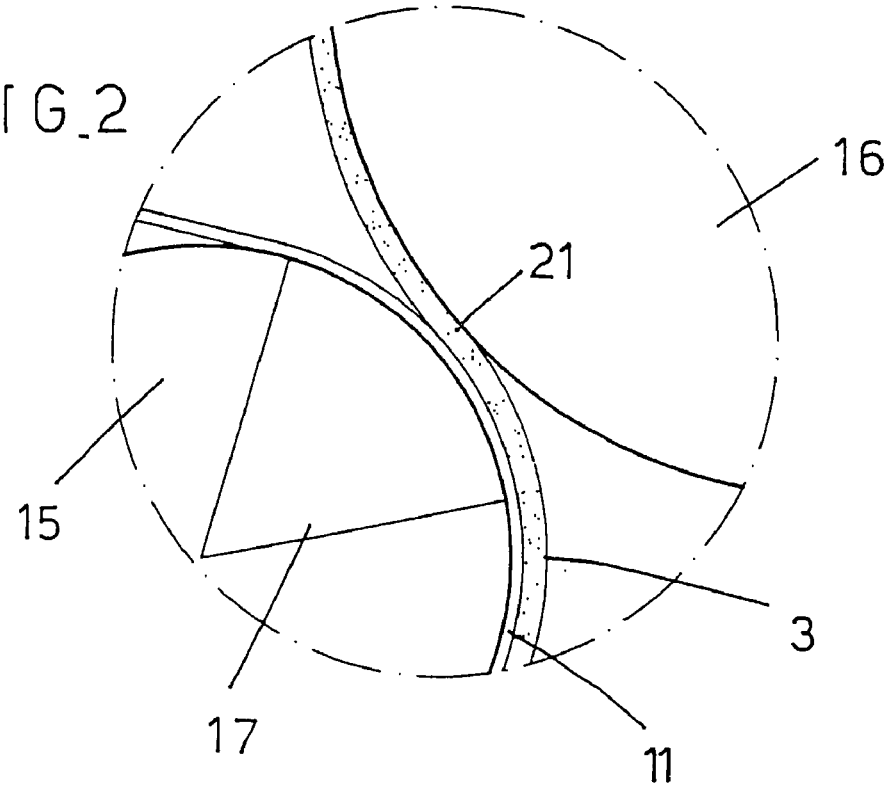
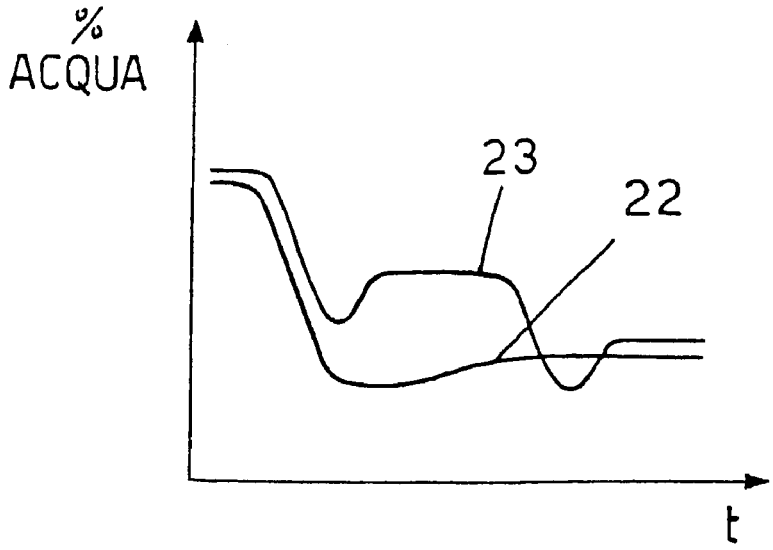
FIG_3

APPARATUS FOR CONTINUOUSLY PRODUCING A BAND OF PAPER PARTICULARLY FOR TOILET USE

FIELD OF THE INVENTION

The present invention refers to an apparatus for continuously producing a band of paper particularly for toilet use.

Today, apparatuses for continuously producing a band of paper particularly for toilet use from a virgin cellulose-based paste and/or from used paper are known, comprising a forming section in which the band of paper is formed starting from the cellulose-based paste, a dehydrating section in which the band of paper is dehydrated up to the optimal residual water content, and a reeling section in which the band of paper is reeled.

BACKGROUND OF THE INVENTION

Usually, the dehydrating section comprises one or more presser cylinders covered by a layer of rubber suitable for pressing the band of paper, in turn transported by a felt band, against a dehydrating cylinder.

The presser cylinders have a much smaller diameter than the diameter of the drying cylinder.

The limitations of conventional apparatuses known today are often due to the substantial pressure applied by the presser cylinders, which makes the properties of softness and thickness of the band of paper produced deteriorate.

The high pressure operated by the presser cylinders can cause a compacting of the band of paper with a consequent rigidifying thereof.

Moreover, conventional apparatuses sometimes suffer from wear of the felt band due to the substantial pressure generated by the presser cylinders, deterioration of the rubber coating of the presser cylinders due to the combination of the frequency and length of the elastic deformation cycles to which it is subjected and limited duration of the components due to the high mechanical stresses present, with the consequent idle times of the apparatus for the inspection, maintenance and possible replacement of the components.

Finally, conventional apparatuses sometimes suffers from modest efficiency of dehydration realised by the presser cylinders of the dehydrating section, since a significant reabsorption of water is associated with the at least partial recovery of thickness of the felt band after the action of the presser cylinders, a thing that always forces more than one presser cylinder to be used with a consequent increase in costs linked to the greater complexity of the apparatus.

The technical task proposed of the present invention is, therefore, that of realising an apparatus for continuously producing a band of paper particularly for toilet use that allows the aforementioned technical drawbacks of the prior art to be eliminated.

SUMMARY OF THE INVENTION

In this technical task a purpose of the invention is that of realising an apparatus for continuously producing a band of paper particularly for toilet use that is soft and delicate and extremely voluminous or of low density.

Another purpose of the invention is that of realising an apparatus for continuously producing a band of paper particularly for toilet use that, with respect to conventional apparatuses, allows the efficiency of drainage of liquid operated by the presser cylinder to be improved keeping the suction power thereof unaltered, or allows the same efficiency of drainage to be kept decreasing the suction power.

Yet another purpose of the invention is that of realising an apparatus for continuously producing a band of paper particularly for toilet use that ensures a long duration of the rubber coating of the presser cylinder and of the other components, so as to limit the idle times of the apparatus for inspection, maintenance and possible replacement of the components and to increase productivity.

The last but not least purpose of the invention is that of realising an apparatus for continuously producing a band of paper particularly for toilet use that optimizes the efficiency of dehydration of the band of paper so as to simplify, if possible, the structure as well as the operation of the apparatus itself.

The technical task, as well as these and other purposes, according to the present invention are accomplished by an apparatus for continuously producing a band of paper, comprising at least forming means of said band of paper starting from a cellulose-based paste, a felt conveyor belt suitable for transporting said band of paper through dehydrating means having at least one presser cylinder suitable for pressing said band of paper against a drying cylinder, characterised in that said presser cylinder has a diameter no smaller than one third of the diameter of said drying cylinder.

The limited difference in the radius of curvature between the presser cylinder and the drying cylinder determines a greater extension of the surface of the band of paper compressed by the presser cylinder, and allows the overall force applied by the presser cylinder on the band of paper to be kept unchanged whilst still reducing the contact pressure.

On the other hand, the reduction in contact pressure allows a product to be obtained having optimal characteristics of softness, delicateness and lightness, also due to the fact that the final thickness of the band of paper, as stated above, is greater than that which can be obtained under the same conditions by a conventional apparatus.

The invention also discloses a process for continuously producing a band of paper, particularly for toilet use, from a cellulose-based paste, with an apparatus comprising at least one felt conveyor belt suitable for transporting said band of paper through dehydrating means having at least one presser cylinder suitable for pressing said band of paper against a drying cylinder, characterised in that the efficiency of dehydration of said band of paper operated by said presser cylinder is optimized providing said presser cylinder with a diameter no smaller than one third of the diameter of said drying cylinder so as to increase the extension of the compressed surface of said band of paper.

Other characteristics of the present invention are defined, furthermore, in the subsequent claims.

BRIEF DESCRIPTION OF THE DRAWINGS

Further characteristics and advantages of the invention shall become clearer from the description of a preferred but not exclusive embodiment of the apparatus for continuously producing a band of paper from a cellulose-based paste according to the finding, illustrated for indicating and not limiting purposes in the attached drawings, in which:

FIG. 2 shows an enlargement of the detail indicated by a dashed circle of FIG. 1; and FIG. 3 shows a typical progression of the water content of a band of paper subjected to dehydration through a presser cylinder according to the present invention, compared with a typical progression of the water content of a band of paper subjected to dehydration through a pair of conventional presser cylinders arranged in succession along the path of the band of paper in the dehydrating section.

DETAILED DESCRIPTION OF THE INVENTION

Figure 1:
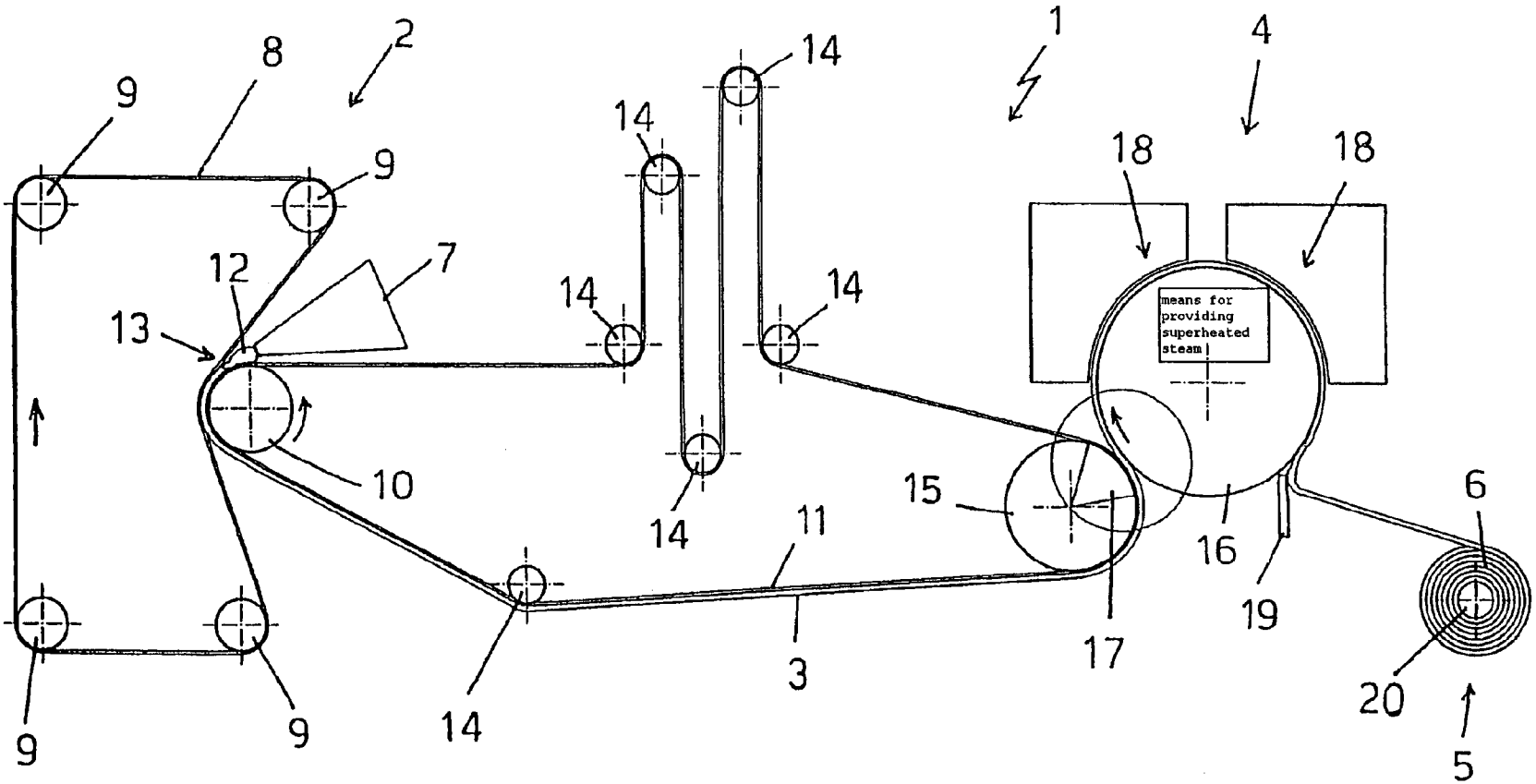
FIG. 1 shows a schematic view of an apparatus for continuously producing a band of paper from a cellulose-based paste according to a preferred embodiment of the finding.

With reference to the quoted figures, an apparatus for continuously producing a band of paper particularly for toilet use is shown, wholly indicated with reference numeral 1.

The apparatus comprises forming means 2 of a band of paper 3 starting from a virgin cellulose-based paste or used paper, dehydrating means 4 of the band of paper 3 and packaging means 5 suitable for realising a reel 6 of the band of paper 3 after its dehydration.

The forming means 2 comprise at least one tank 7 for supplying the paste 12 to a passage 13 with a progressively decreasing section defined between converging branches of a cloth band 8 and of a felt band 11 pressed against the cloth band 8 by a forming cylinder 10.

The cloth band 8 is continuous and is moved by driving (and/or guiding and/or stretching) rollers 9, just as the felt band 11 is continuous and is moved by driving (and/or guiding and/or stretching) rollers 14.

The driving rollers 9 and 14 preferably consist of steel with a rubber coating, whereas the forming cylinder 10 is preferably made from cast iron with a rubber coating.

The cleaning of the cloth band 8 and of the felt band 11 is ensured jointly by rinsing means with pressurised jets of water and/or by scraping means and/or by suction systems that are known.

The felt band 11 carries out the function both of transporting the band of paper 3 through the dehydrating section and of absorbing water from it during the dehydration itself.

The dehydrating means 4 have at least one presser cylinder 15 suitable for pressing the band of paper 3 against a drying cylinder 16.

Advantageously, the presser cylinder 15 has a diameter no smaller than one third of the diameter of the drying cylinder 16.

The presser cylinder 15 also has a suction sector 17 suitable for sucking water from the band of paper 3 in the pressing zone between the presser cylinder 15 and the drying cylinder 16. The water that is drained towards the presser cylinder 15 during pressing is subjected to the action of centrifugal force produced by the rotation of the presser cylinder 15, which in the pressing zone is balanced by the centripetal force produced by the suction sector 17.

When outside of the pressing zone the action of the suction sector 17 is interrupted, the water thus drained by the presser cylinder 15 is discharged thanks just to the no longer balanced centrifugal force acting upon it.

Advantageously, foreseeing a presser cylinder 15 with a greater radius with respect to conventional solutions and with the same peripheral speed, determines a reduction in the centrifugal force applied by the presser cylinder 15 on the drained liquid.

Therefore, with respect to conventional apparatuses, by minimising the centrifugal force applied by the presser cylinder 15 on the drainage water it is possible to increase productivity keeping the suction power of the suction sector 17 unchanged, and/or to keep the same productivity decreasing the suction power of the suction sector 17 and thus the energy consumption of the unit.

Preferably, the presser cylinder 15 is made from steel and has a rubber coating layer.

The drying cylinder 16, on the other hand, comprises means for producing superheated steam.

The dehydrating means 4 also comprise at least one distributor 18 suitable for distributing hot air against the portion of the band of paper 3 wound around the drying cylinder 16.

The packaging means 5 comprise a scraper 19 suitable for detaching the band of paper 3 dehydrated by the drying cylinder 16, and a roller 20 suitable for forming the reel 6 with the band 3 of dehydrated paper.

The invention also discloses a process for continuously producing the band of paper 3, in which the optimisation of the efficiency of dehydration of the band of paper 3 operated by the presser cylinder 15 is obtained by forming the presser cylinder 15 with a diameter no smaller than one third of the diameter of the drying cylinder 16 so as to obtain an extended compressed surface 21 (defined between two dotted and dashed segments in FIG. 2) of the band of paper 3.

In particular, the optimisation of the efficiency of dehydration of the band of paper 3 is obtained by limiting the reabsorption of water during the at least partial recovery of thickness of the compressed surface 21 of the band of paper 3.

In FIG. 3, the line 22 of the graph shows a typical progression of the water content of a band of paper subjected to dehydration through a presser cylinder according to the present invention, whereas the line 23 shows a typical progression of the water content of a band of paper subjected to dehydration through a pair of conventional presser cylinders arranged in succession along the path of the band of paper in the dehydrating section, in which each cylinder of such a pair of presser cylinders has a diameter of less than 30% the diameter of the drying cylinder.

As can be seen in the conventional case (line 23) the band of paper 3 has a first minimum water content after the passage through the first presser cylinder and a second minimum after the passage from the second presser cylinder, but during the journey from the first to the second presser cylinder and after the passage from the second presser cylinder there is a non-negligible increase in the water content due to the suction of water from the felt band 11 which occurs during the at least partial recovery of thickness of the compressed band of paper 3.

The reabsorption of water after the compression of the band of paper 3 is somewhat less marked in the case of the present invention (line 22) since the smaller difference in the radius of curvature between the presser cylinder 15 and the drying cylinder 16 determines a greater extension of the surface 21 of the band of paper 3 compressed by the presser cylinder 15, and allows the overall force applied by the presser cylinder 15 on the band of paper 3 to be kept unchanged whilst still reducing the contact pressure.

The reduction in contact pressure naturally also means less mechanical stress and wear of the components, for example less contact wear undergone by the felt band 11 or less deterioration of the rubber coating of the presser cylinder 15, a longer duration thereof and consequently an improvement in the reliability and productivity of the apparatus.

The operation of the apparatus according to the invention is clear from that which has been described and illustrated and, in particular, is substantially the following.

The cellulose-based paste 13 is supplied from the tank 7 between the converging branches of the bands 8 and 14 moved so as to provide the same advancing direction to the paste 13.

The forming cylinder 10, while it rotates, presses the paste 13 that crosses the throat defined between the converging branches of the felt band 11 and the cloth band 8 forming the band of paper 3.

The band of paper 3 thus formed is transported by the felt band 11 up to the dehydrating means 4.

The band of paper 3 is subjected first to the pressure of the presser cylinder 15 and to the simultaneous suction realised by its suction sector 17, then to the flow of hot air of the distributor 18 and simultaneously to the superheated steam generated by the drying roller 16.

At the end of the dehydration the band of paper 3 is detached from the drying cylinder 16 through the scraper 19 and reeled by the means 20.

The apparatus for continuously producing a band of paper particularly for toilet use thus conceived is susceptible to numerous modifications and variants, all of which are covered by the inventive concept; moreover, all of the details can be replaced with technically equivalent elements.

In practice, the materials used, as well as the sizes, can be whatever according to requirements and the state of the art.

The invention claimed is:

1. Apparatus for continuously producing a band of paper, comprising:

at least forming means of said band of paper starting from a cellulose-based paste;

a felt conveyor belt suitable for transporting said band of paper through dehydrating means having at least one presser cylinder suitable for pressing said band of paper against a drying cylinder:

wherein said presser cylinder has a diameter no smaller than one third of the diameter of said drying cylinder, wherein said dehydrating means also comprise at least one distributor suitable for distributing hot air against said band of paper wound around said drying cylinder, and wherein said drying cylinder comprises means for producing superheated steam.

2. Apparatus according to claim 1, wherein said presser cylinder has a suction sector suitable for the suction of water from said band of paper.

3. Apparatus according to claim 1, wherein said forming means comprise at least one tank for supplying said paste to a passage with a progressively decreasing section defined between converging branches of a continuous cloth band and of a continuous felt band pressed against said cloth band by a forming cylinder.

4. Apparatus according to claim 1, wherein said presser cylinder has a rubber coating.

5. Apparatus according to claim 1, further comprising packaging means of said band of paper, comprising a scraper suitable for detaching said dehydrated band of paper from said drying cylinder, and a roller suitable for forming a reel of said dehydrated band of paper.

6. Process for continuously producing a band of paper from a cellulose-based paste, with an apparatus comprising at least one felt conveyor belt suitable for transporting said band of paper through dehydrating means having at least one presser cylinder suitable for pressing said band of paper against a drying cylinder, wherein the efficiency of dehydration of said band of paper operated by said presser cylinder is optimized by providing said presser cylinder with a diameter no smaller than one third of the diameter of said drying cylinder so as to increase the extension of the compressed surface of said band of paper, wherein the productivity and/or the energy consumption of the apparatus for continuously producing said band of paper is optimized by minimizing the centrifugal force generated on the drainage water from said presser cylinder by using a suction sector subtending an arc less than 90°.

7. Process according to claim 6, wherein the efficiency of dehydration of said band of paper is optimized by limiting the reabsorption of water during the at least partial recovery of thickness of said compressed surface of said band of paper.

8. Apparatus for continuously producing a band of paper, comprising:

at least forming means of said band of paper starting from a cellulose-based paste;

a felt conveyor belt suitable for transporting said band of paper through dehydrating means having at least one presser cylinder suitable for pressing said band of paper against a drying cylinder:

wherein said presser cylinder has a diameter no smaller than one third of the diameter of said drying cylinder, and wherein said presser cylinder has a suction sector suitable for the suction of water from said band of paper, said suction sector subtending an arc less than 90°.

* * * * *